US006447158B1

(12) United States Patent
Farkas

(10) Patent No.: US 6,447,158 B1
(45) Date of Patent: Sep. 10, 2002

(54) APERTURED-DISK MIXER

(76) Inventor: Frank E. Farkas, 2343 E. Sweetbriar Dr., Fayetteville, AR (US) 72703

( * ) Notice: Subject to any disclaimer, the term of this patent is extended or adjusted under 35 U.S.C. 154(b) by 0 days.

(21) Appl. No.: 09/650,206

(22) Filed: Aug. 29, 2000

(51) Int. Cl.[7] ..... B01F 7/26

(52) U.S. Cl. ..... 366/316; 366/169.1; 366/172.1; 366/317; 366/340

(58) Field of Search ..... 366/336, 340, 366/341, 169.1, 247, 316, 317; 48/189.4; 138/40, 42; 55/445, 446

(56) References Cited

U.S. PATENT DOCUMENTS

| | | | | |
|---|---|---|---|---|
| 128,693 | A | * | 7/1872 | Williams |
| 1,390,096 | A | * | 9/1921 | Di Sante |
| 1,857,348 | A | * | 5/1932 | Bokenkroger |
| 3,018,841 | A | * | 1/1962 | Gerlich |
| 3,041,051 | A | * | 6/1962 | Reiffen |
| 3,361,412 | A | | 1/1968 | Cole, III |
| 3,693,457 | A | * | 9/1972 | Pilat |
| 3,756,570 | A | | 9/1973 | Buhner |
| 3,913,894 | A | * | 10/1975 | McFarren |
| 3,941,355 | A | | 3/1976 | Simpson |
| 4,129,624 | A | | 12/1978 | Kates |
| 4,135,180 | A | | 1/1979 | White |
| 4,441,823 | A | | 4/1984 | Power |
| 4,647,212 | A | | 3/1987 | Hankison |
| 4,848,920 | A | | 7/1989 | Heathe et al. |
| 5,137,369 | A | * | 8/1992 | Hodan |
| 5,232,283 | A | | 8/1993 | Goebel et al. |
| 5,237,369 | A | | 8/1993 | Maruta et al. |
| 5,460,449 | A | | 10/1995 | Kent et al. |
| 5,547,281 | A | | 8/1996 | Brooks |
| 5,863,129 | A | | 1/1999 | Smith |
| 5,928,521 | A | | 7/1999 | Levec |
| 5,997,283 | A | | 12/1999 | Spiros |
| 6,000,839 | A | | 12/1999 | Lott |
| 6,033,103 | A | | 3/2000 | Schuchardt |

* cited by examiner

*Primary Examiner*—Charles E. Cooley
*Assistant Examiner*—David Sorkin
(74) *Attorney, Agent, or Firm*—Ray F. Cox, Jr.

(57) ABSTRACT

A fluid handling device to assist in the mixing or separation of two or more fluids utilizing a stack of two types of alternating plates. A first plate has an aperture; a second plate has peripheral spaces around which the fluids may flow. Both types of plates are provided with a plurality of projections that serve to space the plates apart and to provide additional turbulence to the fluids as they flow around the projections. The fluids are forced to proceed back and forth through the alternating plates. The plates may be designed to fit within a housing of circular or polygonal cross-section. The projections may be tapered or non-tapered. The projections may be circular or polygonal in cross-section. Further the heights of the projections may vary to adjust the separation between adjacent pairs of plates to obtain the appropriate degree of turbulence for optimum mixing or separation of the fluids. Fluids may be introduced into the housing containing the stack of plates at various points as required by the particular fluids being handled.

6 Claims, 12 Drawing Sheets

APERTURED-DISK MIXER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to fluid handling devices, and in particular, to fluid handling devices employing a plurality of stacked plates for dispersal, separation and turbulent mixing of fluids.

2. Brief Description of the Related Art

There are numerous applications requiring the continuous mixing of two or more fluids. Example includes foams, paints, solvents, and components of chemical processes. Such fluids may have varying degrees of viscosity and miscibility which can render thorough mixing difficult to achieve on a continuous basis. Information relevant to attempts to address this problem can be found in the following U.S. patents. These references mentioned in this background section are not admitted to be prior art with respect to the present invention.

A typical example of an in-line mixing device is disclosed in U.S. Pat. No. 3,941,355 to Simpson. Simpson discloses a device for mixing foam ingredients. A series of longitudinally spaced discs are disposed on a shaft within a cylindrical bore. The discs have radial slots on alternating sides of the discs so that the fluids are forced to take a path which flows through the alternating slots and divides and flows around the shaft in the space between the discs. U.S. Pat. No. 3,363,412 to Cole discloses a similar pattern of alternating cutouts on the sides of a plurality of stacked discs. However, Cole does not have the central shaft of Simpson.

U.S. Pat. No. 5,547,281 to Brooks discloses a mixing apparatus having first and second end walls and an intermediate wall disposed between the end walls in a tubular member. The end walls have at least one aperture and the intermediate wall is spaced from the interior of the tubular member to form an annular passage. The fluids to be mixed therefore flow through the apertures in the first end wall, through the annular passage around the intermediate wall, and then exit through the aperture in the second end wall.

U.S. Pat. No. 5,232,283 to Goebel et al. discloses a mixing apparatus comprising a tray with an aperture in the middle. A cap with opposed openings covers the aperture. Fluids pass through the opening into a pan below the tray. A tube encircling the aperture below the cap has notches to allow the fluids to enter the pan. Radially spaced risers extending from the bottom of the pan have upper ends above the notches and below the tray. The risers have openings through which the fluids pass.

U.S. Pat. No. 4,441,823 to Power discloses a liquid mixer with a plurality of slotted plates spaced apart within a chamber. The slots are angled to the exit face of the plate so as to induce turbulence. The slots are preferably radially disposed in the circular plates.

U.S. Pat. No. 5,863,129 to Smith discloses a mixing device comprising stacks of three different types of cylindrical mixing elements. Each of the mixing elements has a pair of inlets, a central chamber and an outlet.

U.S. Pat. No. 5,997,283 to Spiros discloses an electrolysis system in which a stack of plates have a polygonal shape and have projections by which the plates are spaced apart.

Each of these references suffers from the disadvantage of not inducing sufficient turbulence and intermingling of the fluids to thoroughly mix fluids of varying viscosity and miscibility. Further, fluid separation may also be accomplished more efficiently by devices having enhanced resistance to fluid motion, which may be developed by structures related to the same type of structures that enhance turbulence.

The limitations of the prior art are overcome by the present invention as described below.

BRIEF SUMMARY OF THE INVENTION

The present invention is directed to a device that satisfies the needs identified above. The invention is a fluid handling device to assist in the mixing or separation of two or more fluids. Depending on the application, structures in the device enhance turbulence in moving fluids or provide resistance to fluid motion. In the first case mixing is enhanced; in the second, separation is enhanced.

The device utilizes a stack of plates. Two types of plates are alternated to achieve the mixing or separation effect. One type of plate has peripheral spaces around which the fluids may flow; the other type of plate has at least one aperture, which may be centrally located. Both types of plates are provided with a plurality of projections that serve to space the plates apart and to provide additional turbulent mixing or enhanced fluid resistance of the fluids as they flow around the projections. When being mixed, the fluids are forced to proceed back and forth through the alternating plates until thoroughly mixed.

The device may also be employed for separation of fluid components based on varying density of the fluid components. The preferred embodiment for fluid separation mounts the plates for rotation within a housing so that the separation effect occurs by centrifugal effects enhanced by the resistance to fluid motion provided by the plates and projections within the device.

In a preferred embodiment of the present invention directed to mixing of two or more fluids, the fluids may be introduced through a plate with at least one aperture, then forced around the periphery of the next plate and so forth. When mixing two or more fluids, the fluid flow is alternately divided and recombined for thorough mixing.

While the plates may be adapted for use in a cylindrical housing, the invention is not so limited. The plates may, for example, be designed to fit within a housing of polygonal cross-section. In such a case, the second type of plate having the central aperture may have the same polygonal cross-section. The first type of plate is then shaped so that the extreme points on the periphery fit against the walls of the housing while the peripheral segments between these extreme points are withdrawn from the walls of the housing so as to provide gaps around which the fluids may flow.

The projections may be tapered and circular in cross-section. Other shapes, both tapered and non-tapered, are contemplated as being within the scope of the invention. The projections, may for example, be square, or more generally, polygonal in cross-section. More angular shapes may assist in turbulent mixing or provide enhanced fluid resistance. These more angular shapes may be desirable depending on the viscosity of the fluids. Various numbers and arrangements of the projections are contemplated as being within the scope of the invention. Further the heights of the projections may vary depending upon the application. For example, depending on the viscosity of the fluids being handled, it is desirable to adjust the separation between adjacent pairs of plates to obtain the appropriate degree of turbulence for optimum mixing or fluid separation. The mixing effect may be enhanced by placing a plurality of spheres between the projections. The spheres are sized to have a diameter less than the height between the plates and less than the distance separating the projections so that the spheres are able to tumble in the fluids. The tumbling action not only enhances mixing but also may be useful in grinding and dispersing solid particles in the fluids.

The device is intended to be applicable to the mixing or separation of a plurality of fluids. The fluids may be introduced into the housing containing the stack of plates at various points as required by the particular fluids being mixed. For example, two fluids to be mixed may advantageously be introduced at one end of the housing and the two fluids will be mixed together through the entire series of plates. Alternatively, one or more fluids may be introduced into, or removed from, the housing at points along the fluid path after one or more fluids have been introduced into the first end of the housing.

The device may be mounted both horizontally or vertically with respect to the major axis of the device. The plates may be interlocked and mounted for rotation within the housing for separation or mixing of fluids. The device may be employed for both mixing and separation operations simultaneously. For example, two liquids, at least one of which contains a gaseous component, could be introduced at one end of the device. As the two liquids are mixed, the gaseous component, from the effect of gravity alone or as enhanced by centrifugal effects, would tend to separate from the mixed liquids and could therefore be drawn off at some intermediate point from the device.

The description above has used the term "fluid" to mean both liquids and gases, including liquids and gases carrying entrained and suspended solids. The plates may be constructed of any suitable material for the type of fluids being mixed.

It is therefore an object of the present invention to provide for device to assist in the mixing or separation or two or more fluids in which a stack of two types of plates are alternated to achieve a fluid resistance effect.

It is a further object of the present invention to provide for such a fluid handling device is which one type of plate has peripheral spaces around which the fluids may flow and the other type of plate has at least one aperture which may be centrally located.

It is also an object of the present invention to provide such a fluid handling device in which the plates are spaced apart by pluralities of projections which assist in the turbulent mixing or separation of the fluids.

It is a still further object of the present invention to provide such a fluid handling device in which the stacked plates are interlocked together and mounted for rotation within a housing.

These and other features, objects and advantages of the present invention will become better understood from a consideration of the following detailed description of the preferred embodiments and appended claims in conjunction with the drawings as described following:

BRIEF DESCRIPTION OF THE SEVERAL VIEWS OF THE DRAWINGS

FIG. 20 is an oblique view of the alternative rotational embodiment of the device.

FIG. 21 is a cross-sectional elevation of the embodiment of FIG. 20 along the line 21—21. The plates are interlocked for rotation as a unit. The uppermost plate interlocks with a drive shaft for rotation of the plates within the housing. Fluids are introduced through a central bore of the drive shaft.

FIG. 22 is a top cross-sectional view along the line 22—22 of FIG. 21 showing depressions in the top surface of a plate for receiving lengthened projections of the next plate so that the plates lock together for rotation.

FIG. 23 is a top cross-sectional view along the line 23—23 of FIG. 21 showing a modification to the uppermost plate for receiving an end of the drive shaft.

FIG. 24 is an exploded elevational view of two plates, a first plate and a second plate, showing the manner in which the two plates interlock by means of depressions and lengthened projections.

FIGS. 25 and 26 show an alternative embodiment of the rotational device of FIGS. 20 and 21. In FIGS. 20 and 21, a fluid inlet is provided through the drive shaft. In FIGS. 25 and 26, fluids are introduced through separate inlet ports.

FIG. 25 is an oblique view of the alternative embodiment in which fluids are introduced into the rotational device through separate inlet ports.

FIG. 26 is a cross-sectional elevation view of the embodiment of FIG. 25 taken along the line 26—26.

DETAILED DESCRIPTION OF THE INVENTION

With reference to FIGS. 1–26, the preferred and alternative embodiments of the present invention may be described. The present invention is a fluid handling device to assist in the mixing or separation of two or more fluids. Depending on the application, structures in the device enhance turbulence in moving fluids or provide resistance to fluid motion. In the first case mixing is enhanced; in the second, separation is enhanced.

The device utilizes a stack of plates. Two types of plates are alternated to achieve the mixing or separation effect. One type of plate has peripheral spaces around which the fluids may flow; the other type of plate has at least one aperture, which preferably is located toward the center of the plate. Both types of plates are provided with a plurality of projections that serve to space the plates apart and to provide additional turbulent mixing or enhanced fluid resistance of the fluids as they flow around the projections.

Figure 1:
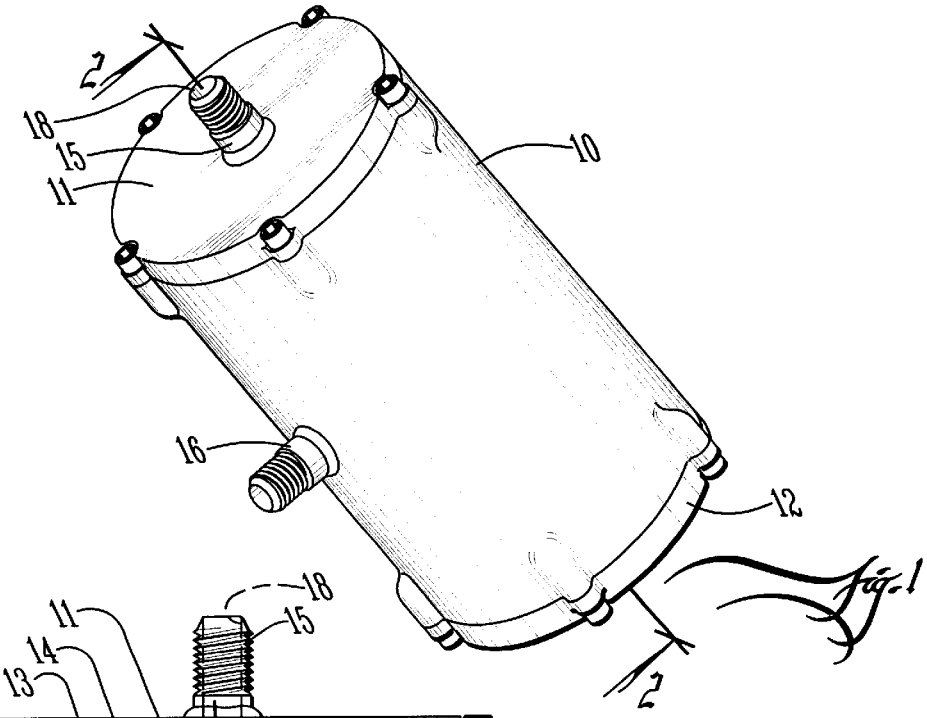
FIG. 1 is an oblique view of one embodiment of the fluid handling device of the present invention wherein the device is provided with end ports and a side port.
Figure 2:
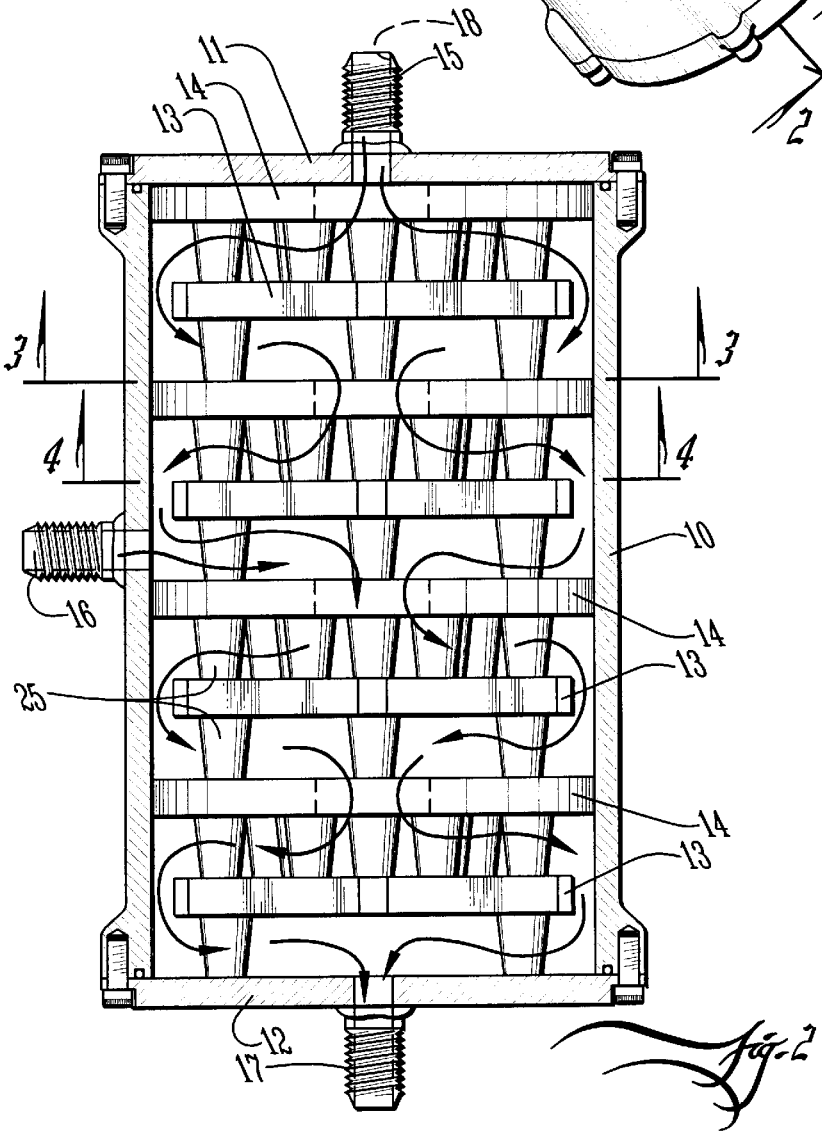
FIG. 2 is an cross-sectional elevation view of the device of FIG. 1 showing fluid flow paths through a plurality of stacked plates from an end port and the side port to another end port.

FIG. 1 is an oblique view of one embodiment of the fluid handling device of the present invention wherein the device has a cylindrical housing 10 closed by an inlet end wall 11 and an outlet end wall 12. The same device is shown in FIG. 2 in an cross-sectional elevation view showing fluid flow paths through a plurality of stacked plates 13, 14 from an inlet end port 15 and a side port 16 to an outlet end port 17. The inlet end port 15 is affixed to the inlet end wall 11. A bore 18 through the inlet end port 15 and the inlet end wall 11 communicates with the interior of the housing 10 for the introduction of fluids into the housing 10. In a similar manner, the side port 16 and the outlet end port 17 allow fluid communication to and from the interior of the housing 10.

In the embodiment of FIGS. 1–4, the side port 16 is shown as an inlet for fluid being introduced into the interior of the housing 10. However, the side port 16 may also be used to remove fluids from the housing 10 as will be described more fully below.

Figure 3:
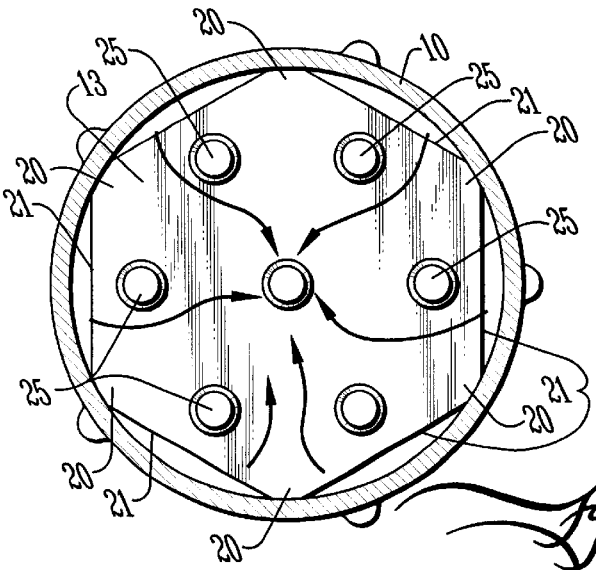
FIG. 3 is a bottom cross-sectional view along the line 3—3 of FIG. 2 which shows a first plate configured for flow around segments of the outer periphery of the plate.
Figure 4:
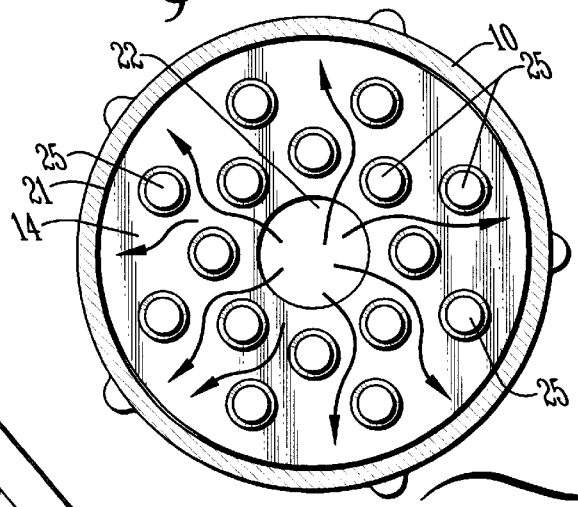
FIG. 4 is a bottom cross-sectional view along the line 4—4 of FIG. 2 which shows a second plate configured for flow through a central aperture of the plate.
Figure 5:
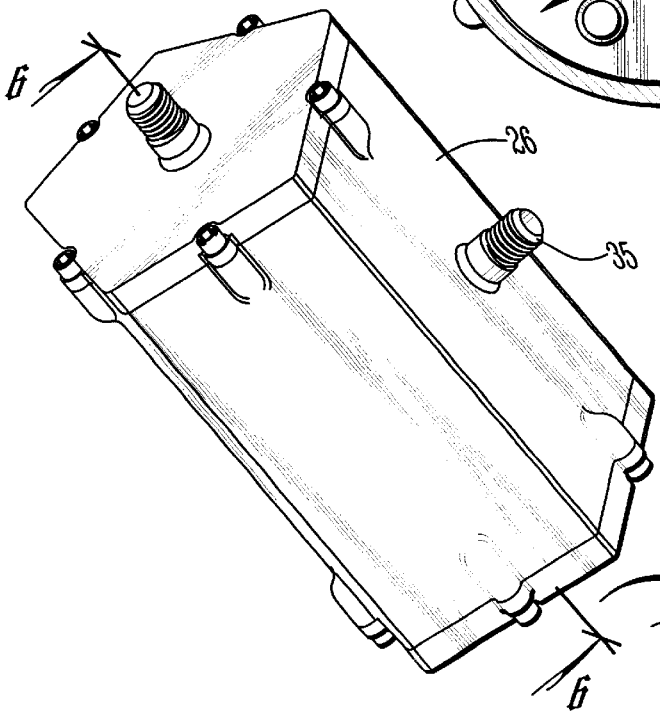
FIG. 5 is an oblique view of an alternative embodiment of the present invention wherein the housing of the device is polygonal in cross-section rather than circular as in the embodiment of FIG. 1.
Figure 13:
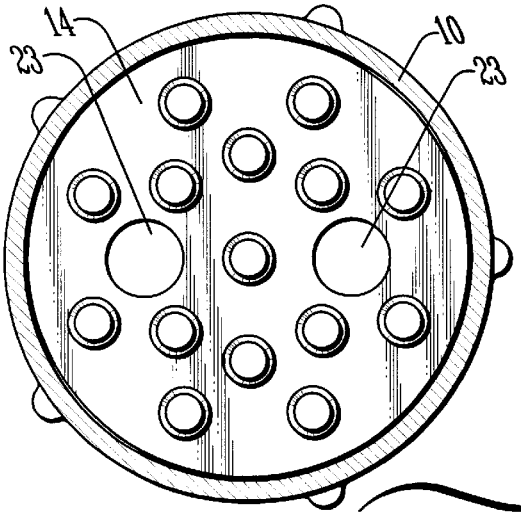
FIG. 13 is a cross-sectional end view of an alternative embodiment of the second type of plate wherein the second plate is provided with more than one central aperture.

FIGS. 3 and 4 illustrate the two types of plates which together comprise the stack of plates shown in FIG. 2. The first plate 13 has an outer periphery with a plurality of extreme points 20 and segments 21 between the extreme points 20. The extreme points 20 contact the inner surface of the housing 10, while the segments 21 are withdrawn from the inner surface of the housing 10 so as to create gaps 22 between the peripheral segments 21 and the inner surface of the housing 10. Fluids introduced into the housing 10 are therefore able to flow around the periphery of the first plate 13. The second plate 14 has a periphery substantially approximating the inner surface of the housing 10. In the embodiment of FIG. 4, the housing 10 is cylindrical and therefore having a circular cross-section, the periphery of the second plate 14 is also circular of substantially the same diameter so that the periphery of the second plate 14 contacts the inner surface of the housing 10 without substantial gaps between the periphery and the inner surface of the housing 10. To allow fluid flow past the second plate 14, the second plate is provided with an aperture 22. In the embodiment of FIG. 4, the aperture is centrally located around a central axis of the plate 14, but other embodiments are contemplated where the aperture is located away from the central axis of the second plate 14. As shown in FIG. 13, the second plate 14 may have multiple apertures 23.

Although the embodiments of the plates 13, 14 shown in FIGS. 1–4 have upper and lower surfaces that are flat and horizontal, the plates could also be sloped as will be described more fully hereinafter.

The plates 13, 14 are stacked within the housing 10 in alternating fashion so that the fluid flow alternates between the first plate 13 and the second plate 14. The fluid flow is thus through the apertures 22 of the second plates 14 and around the peripheral segments 21 of the first plates 13. The flow is thus alternately divided and recombined to enhance mixing of the fluid.

Further, the plates 13, 14 have first sides and second sides. Projections 25 on the second sides of the plates 13, 14 serve to space the plates 13, 14 apart when stacked in the housing 10. The height of the projections 25 thus define the separation distance between adjacent pairs of plates 13, 14. The separation distance may be varied for different applications due to the viscosity or other characteristics of the fluids being handled in the device.

The projections 25 also enhance the turbulence induced in the fluids in the device. The projections 25 serve to further enhance the dividing and recombining of the fluid flows as the fluid is forced around the projections 25. In addition, as described more fully below, the shape of the projections 25 may be selected for enhanced turbulence effects.

The stacked plates 13, 14 shown in FIG. 2 complete fill the housing 10. It should be recognized that in particular applications, the use of fewer plates may be desirable, for example, to adjust the degree of mixing or separation achieved by the device. In such a case the housing 10 may be equipped with fewer plates 13, 14 and the remaining space not occupied with the plates filled with annular collars which would serve to secure the stacked plates 13, 14 against movement but would not interfere with the fluid flow. An annular collar with the same thickness as a plate (including the projections) would serve to replace a single plate and thus there would be optimum flexibility to adjust the number of plates 13, 14 in the housing from one or two up to the maximum complement of plates 13, 14 allowed by the length of the housing 10.

While the embodiment of FIGS. 1–4 discloses a cylindrical housing 10, in the alternative embodiment of FIGS. 5–8, the housing 26 is polygonal in cross-section. Various shapes of the housing and plates are contemplated as being within the scope of the present invention and the particular embodiments shown are not intended to limit the invention to only those particular embodiments.

Figure 7:
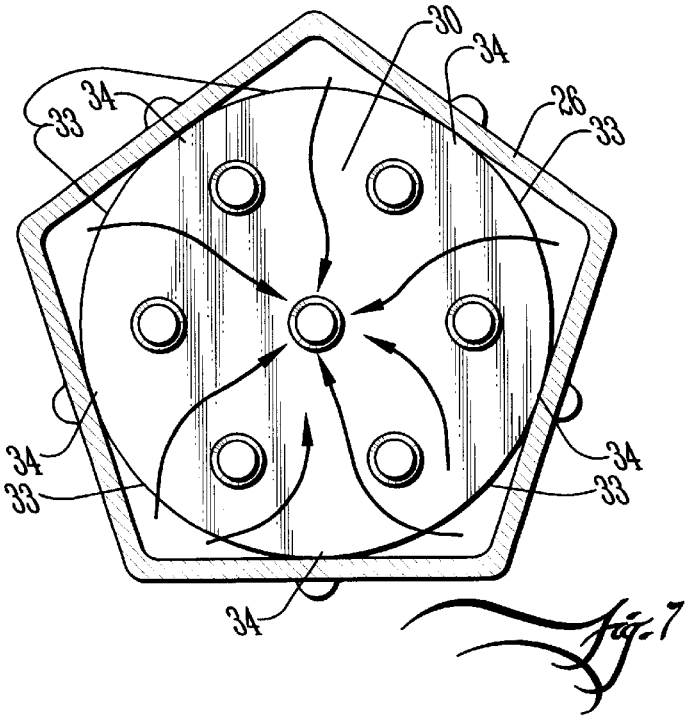
FIG. 7 is a bottom cross-sectional view along the line 7—7 of FIG. 6 which shows a first plate configured for flow around segments of the outer periphery of the plate. This figure differs from the analogous FIG. 3 in that the first plate is configured to be mounted in a polygonal housing.
Figure 8:
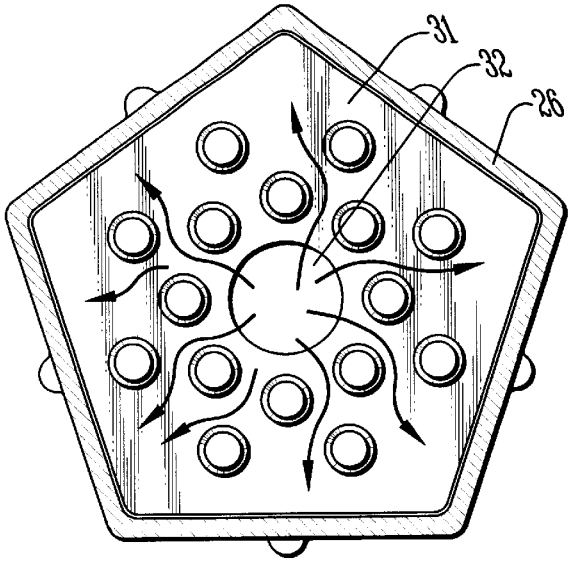
FIG. 8 is a bottom cross-sectional view along the line 8—8 of FIG. 6 which shows a second plate configured for flow through a central aperture of the plate. This FIG. differs from the analogous FIG. 4 in that the second plate is configured to be mounted in a polygonal housing.

Analogous to FIG. 3 for a cylindrical housing 10, FIG. 7 shows a first plate 30 for a polygonal housing. The fluids flow around the periphery of the plate 30 where peripheral segments 33 allow gaps next to the inner surface of the housing 26 between extreme points 34. Analogous to FIG. 4, FIG. 8 shows a second plate 31 for a polygonal housing 26. The flow is through a central aperture 32 of the plate 31. This figure differs from the analogous FIG. 4 in that the second plate is configured to be mounted in a polygonal housing.

Figure 6:
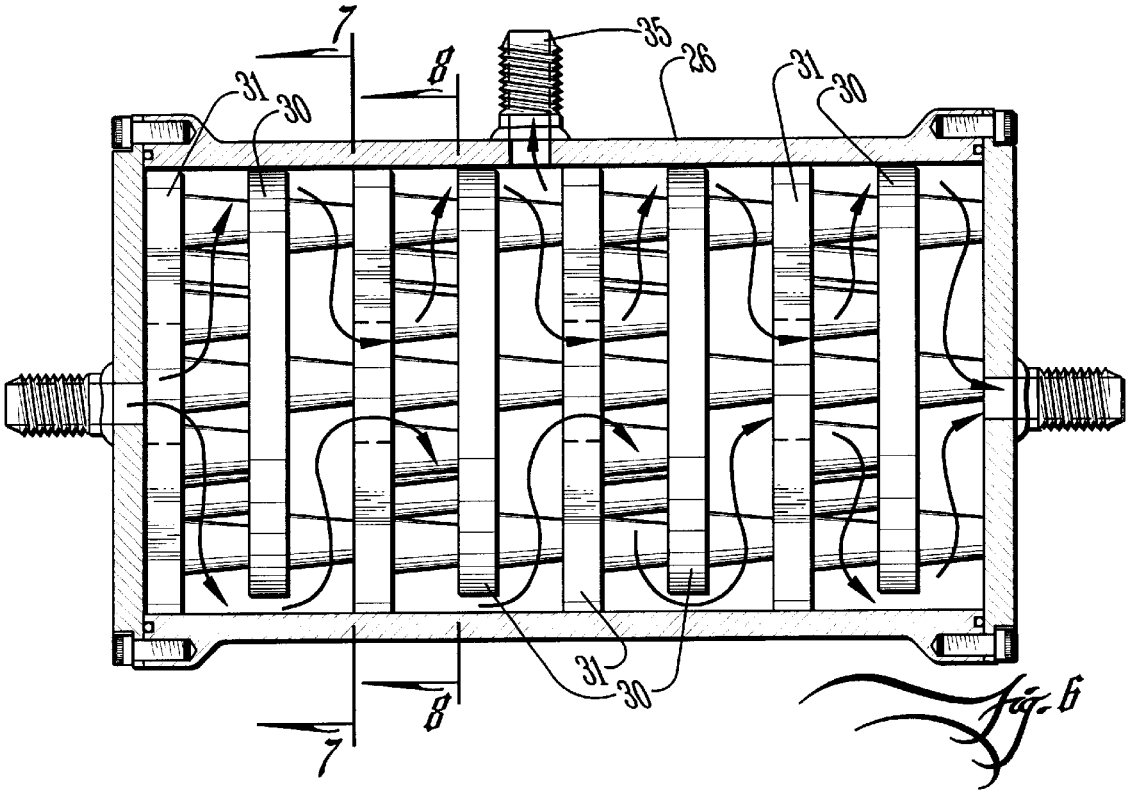
FIG. 6 is a cross-sectional elevation view of the device of FIG. 5 along the line 6—6. This figure also illustrates an alternative embodiment of the present invention wherein the device is oriented horizontally so as to allow lighter fluid components, such as gases, to escape from a side port.

FIG. 6 is also illustrates an alternative embodiment of the present invention wherein the device is oriented horizontally so as to allow lighter fluid components, such as gases, to escape from a side port 35.

Figure 9:
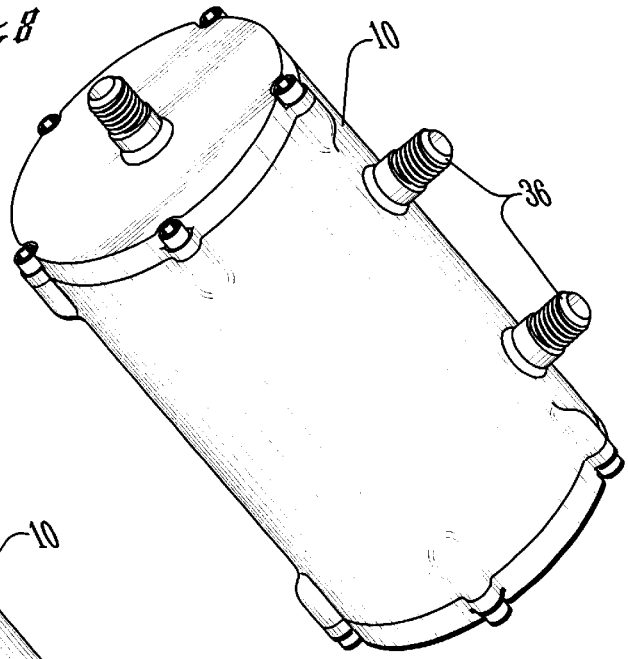
FIG. 9 is an oblique view of an alternative embodiment of the present invention wherein the device is provided with two side ports.
Figure 10:
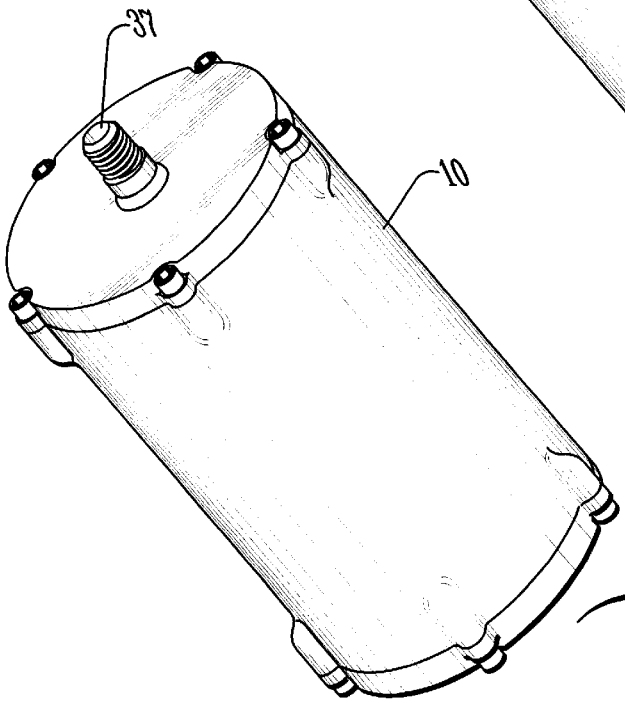
FIG. 10 is an oblique view of an alternative embodiment of the present invention wherein the device is configured without any side ports.
Figure 11:
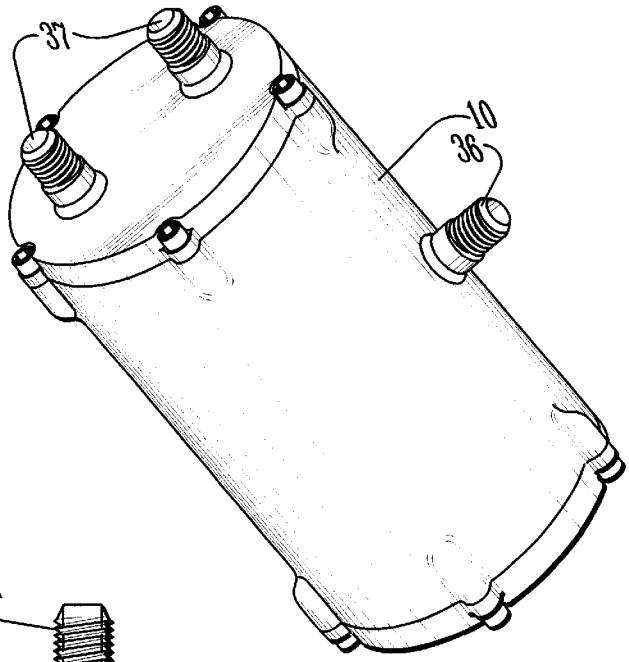
FIG. 11 is an oblique view of an alternative embodiment of the present invention wherein the device is configured with more than one end port in one end of the device.

FIG. 9 is an alternative embodiment of the device of FIGS. 1–4 wherein the device is provided with two side ports 36. FIG. 10 is another alternative embodiment of the present invention wherein the device is configured with an end port 37 but without any side ports, while FIG. 11 is an alternative embodiment of the present invention wherein the device is configured with more than one end port 37 in one end of the device. These examples are not exhaustive but are illustrative of some of the variations contemplated as being within the scope of the invention. Depending upon the application, various numbers and locations of end ports, both inlet and outlet, and side ports may be employed in the practice of the invention.

Figure 12:
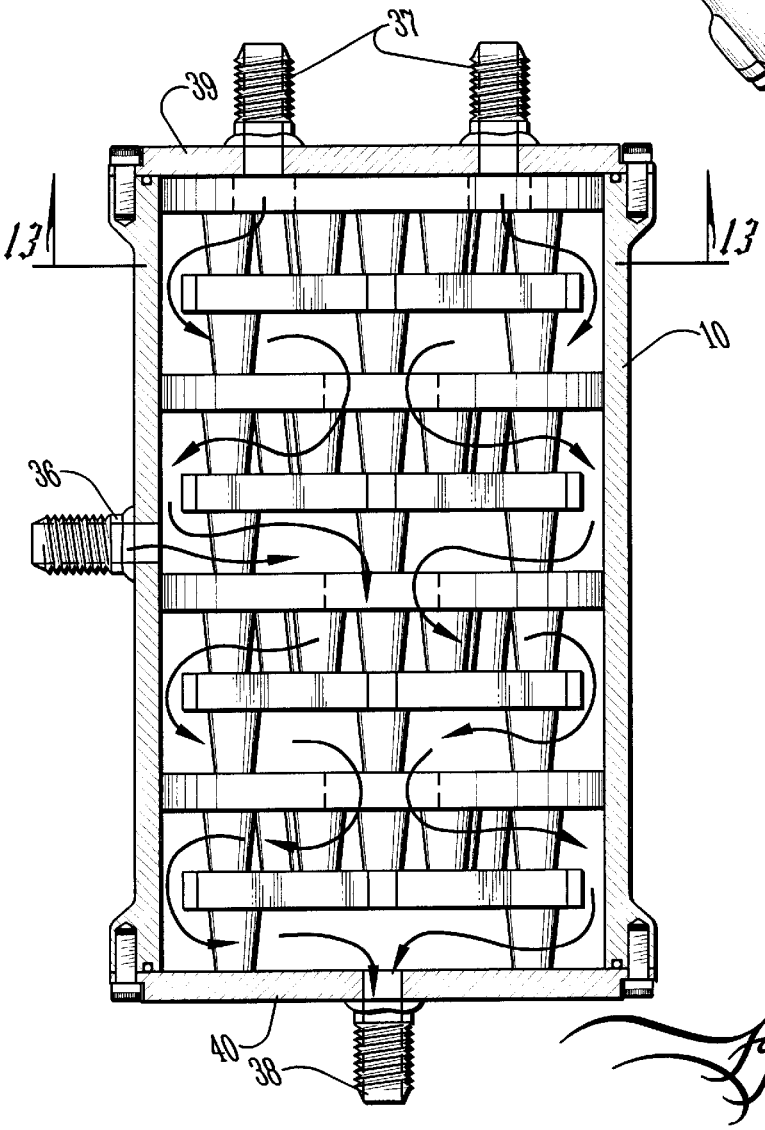
FIG. 12 is a cross-sectional elevation of an alternative embodiment of the present invention wherein the device is configured with two end ports at a first end of the device, a single end port at an opposite end of the device, and a single side port. This configuration could be employed for introducing two fluids through the first end, allowing mixing of the first two components, introducing a third component from the side port, mixing the third component into the first two mixed components, and removing the mixture of all three components from the port in the opposite end of the device.

For example, FIG. 12 shows an embodiment wherein the device is configured with two end ports 37 at a first end 39 of the device, a single end port 38 at an opposite end 40 of the device, and a single side port 36. This configuration could be employed for introducing two fluids through the first end 39, allowing mixing of the first two components, introducing a third component from the side port 36, mixing the third component into the first two mixed components, and removing the mixture of all three components from the port 38 in the opposite end 40 of the device.

Figure 14:
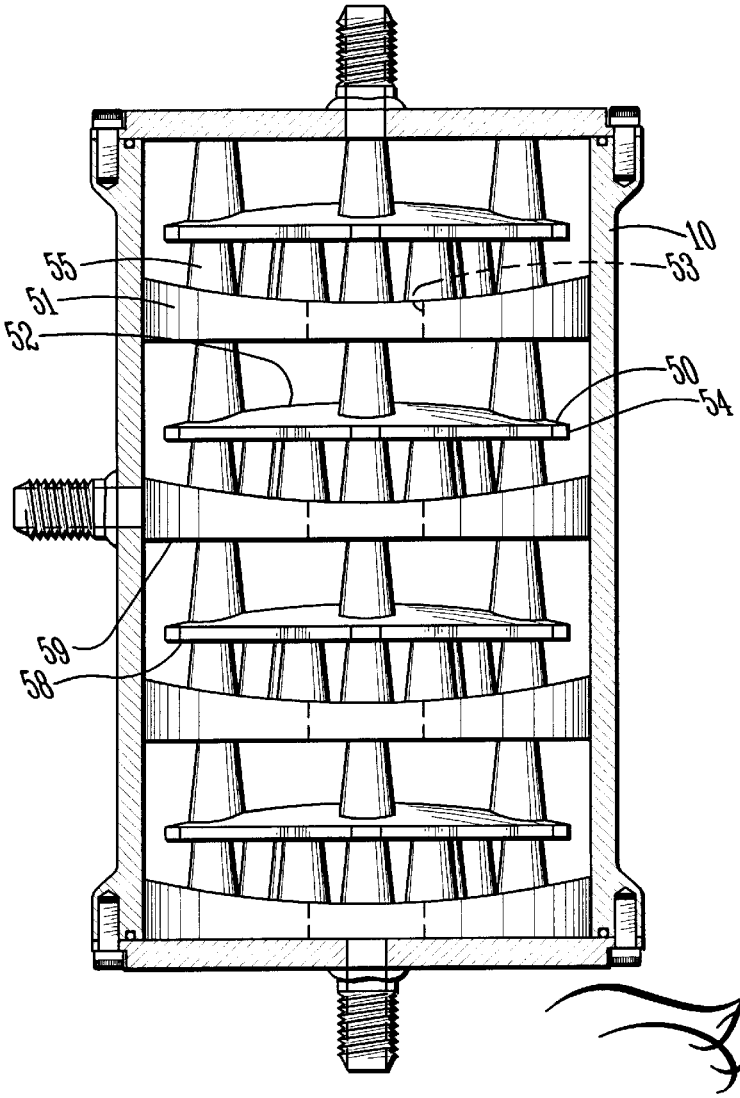
FIG. 14 is a cross-sectional elevation view of an alternative embodiment of the present invention in which the plates are provided with a sloped upper surface to facilitate drainage of fluids from the device. In the embodiment of FIG. 14, the upper surface is curved such that the first plate has a convex upper surface so that the fluids tend to drain to the periphery. The second plate (having a central aperture) has a concave upper surface so that the fluids tend to drain to the central aperture.
Figure 15:
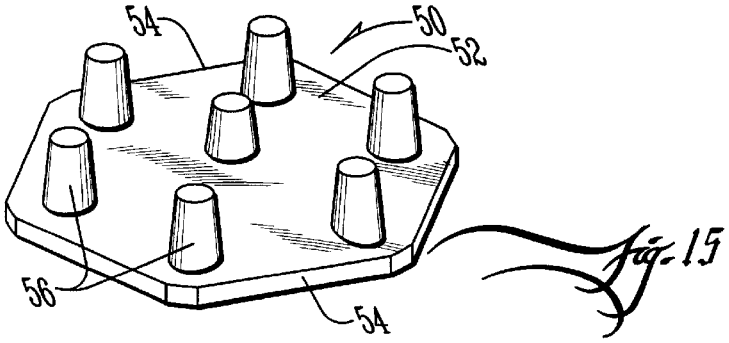
FIG. 15 is an oblique view of the first plate of FIG. 14.
Figure 16:
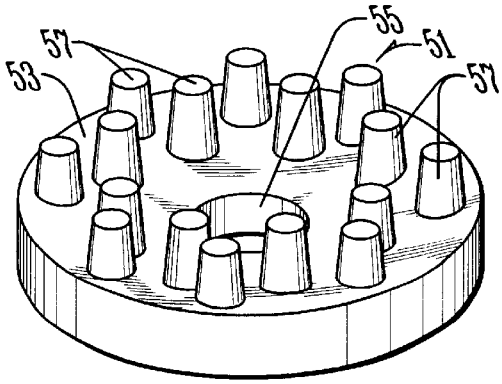
FIG. 16 is an oblique view of the second plate of FIG. 14.

FIG. 14 is an alternative embodiment of the device of FIGS. 1–4 where the plates 13, 14 are replaced with plates 50, 51 which have a sloped upper surface. This slope accelerates drainage of fluids from the device and may enhance mixing. In the embodiment of FIG. 14, the sloped upper surfaces are curved in two dimensions. The first plate 50 has a convex upper surface 52 so that the fluids tend to drain to the periphery 54. The second plate 51 (having a central aperture 55) has a concave upper surface 53 so that the fluids tend to drain to the central aperture 55. If the second plate 51 has more than one aperture or if the aperture is offset from the center, the same type of concave surface, while more complex, may be employed so that the fluids would tend to drain toward the apertures. The heights of the projections 56, 57 vary depending upon the curvature of the respective upper surfaces 52, 53 so as to provide a uniform support for the adjacent plate. The plates 50, 51 are shown in FIGS. 14–16 as having flat lower surfaces 58, 59 opposite to the curved upper surfaces 52, 53. Such flat surfaces may have manufacturing advantages, but in some applications it may be desirable to have the lower surfaces curved to match the curvature of the adjacent upper surfaces to produce a uniform space between adjacent plates.

Figure 17:
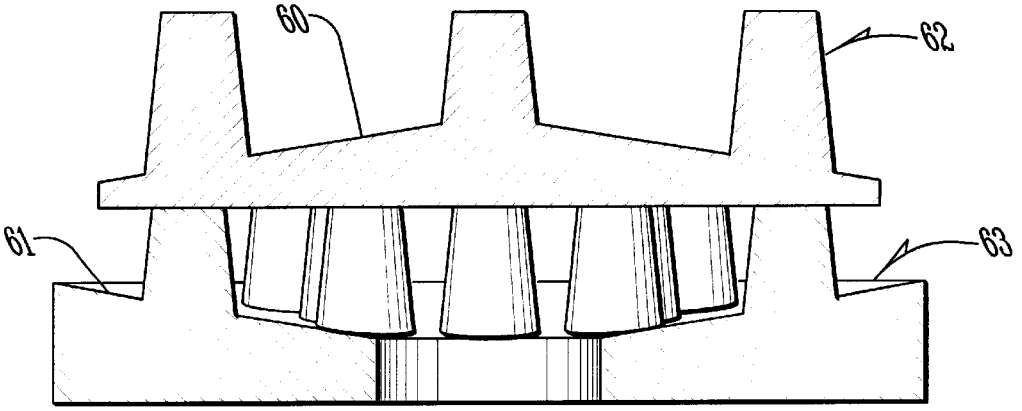
FIG. 17 is a cross-sectional elevation view of an alternative embodiment of the plates of FIGS. 14–16 wherein the sloped upper surfaces of the plates are provided with flat slopes rather than curved slopes.

Also for ease in manufacturing, particularly if molds are employed, it may be desirable for the curved surfaces of FIGS. 14–16 to be replaced with flat surfaces; i.e, simpler surfaces that are not curved in two dimensions but are defined by straight radial lines from the central axis of the plate. Such surfaces are conical or frusto-conical. FIG. 17 shows an alternative embodiment of the plates of FIGS. 14–16 wherein the upper surfaces 60, 61 of the plates 62, 63 are provided with such flat slopes rather than curved slopes. In the case of either the curved or flat slopes, a greater degree of slope or curvature will enhance the mixing effect and accelerate the drainage of fluids from the device.

Figure 18:
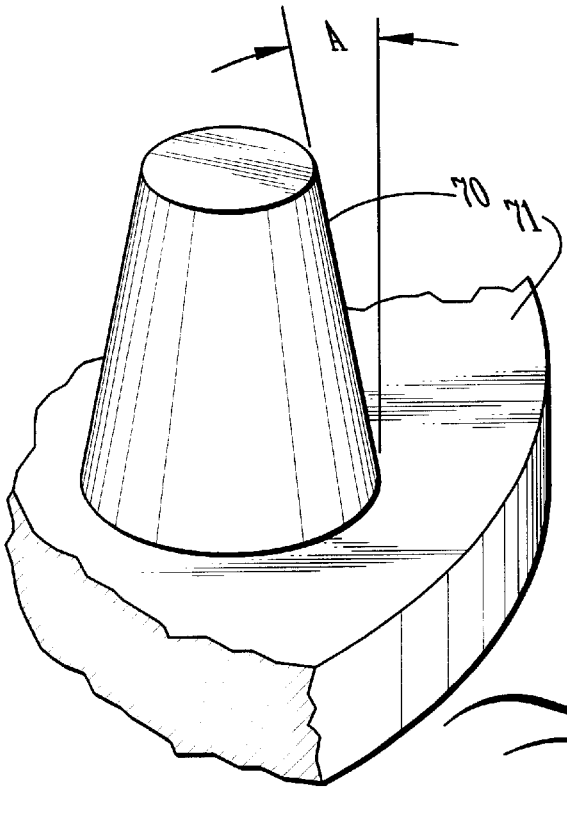
FIG. 18 is a partial oblique view of a single projection of the plates. In this opine embodiment the projection has the form of a truncated cone with an angle A of the outer surface from the vertical.
Figure 19:
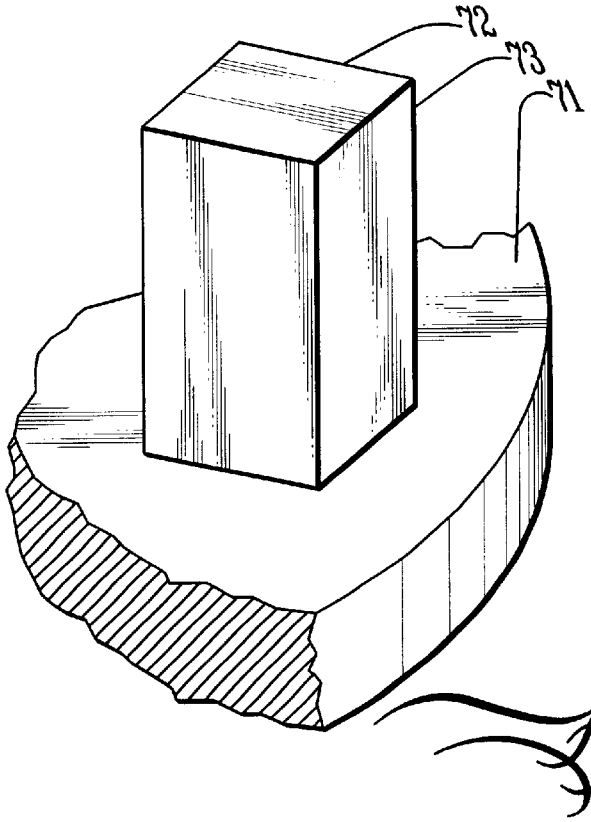
FIG. 19 is a partial oblique view of a single projection of the plates having the form of a polygonal solid. In this embodiment the projection has the form of a rectangular solid with angular edges.

As mentioned above, the projections of the plates may be tapered and circular in cross-section. FIG. 18 shows a single projection 70 of a plate 71. In this embodiment the projection 70 has the form of a truncated cone with an angle A of the outer surface from the vertical. Other shapes, both tapered and non-tapered, are contemplated as being within the scope of the invention. The projections, may for example, be square, or more generally, polygonal in cross-section as shown in FIG. 19 where a projection 72 of the plate 71 is in the form of a polygonal solid. More particularly, in this embodiment the projection 72 has the form of a rectangular solid with sharp angular edges 73. More angular shapes may assist in turbulent mixing or provide enhanced fluid resistance. These more angular shapes may be desirable depending on the viscosity of the fluids. Various numbers and arrangements of the projections are contemplated as being within the scope of the invention.

Figure 19A:
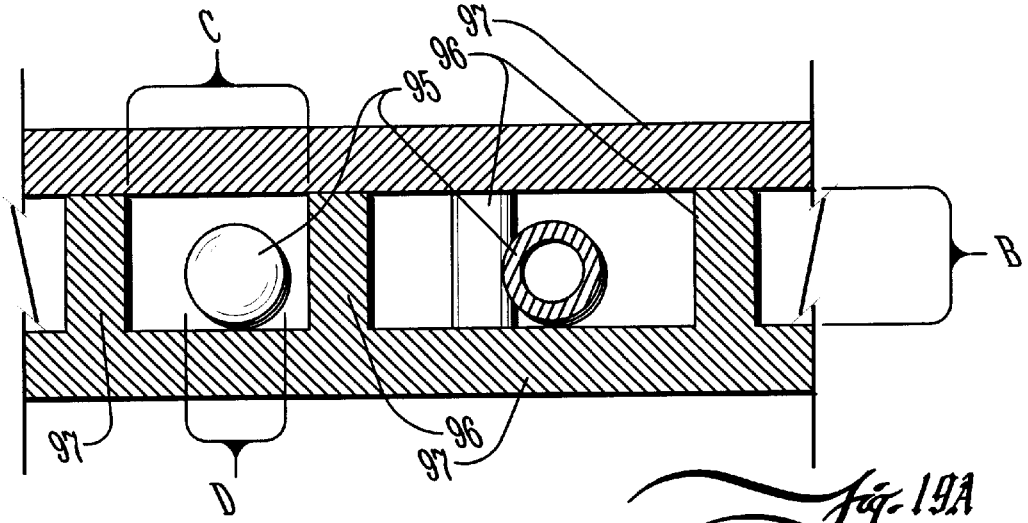
FIG. 19A is a partial elevation view along the line 19A—19A of FIG. 19B of a pair of adjacent plates showing an embodiment of the present invention in which spheres are placed between the projections.
Figure 19B:
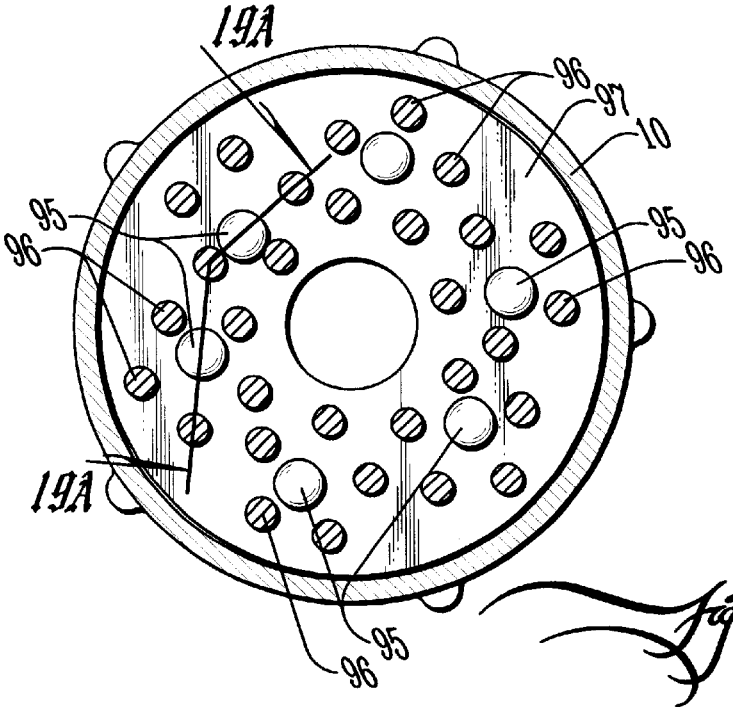
FIG. 19B is a plan view of the embodiment of FIG. 19A.

With reference to FIGS. 19A and 19B, the mixing effect of the device may be enhanced by placing a plurality of spheres 95 between projections 96. The spheres 95 are sized to have a diameter D less than the spacing B between the plates 97 and less than the distance C separating the projections 96 so that the spheres 95 are able to tumble in the fluids. The distance C is not the spacing between adjacent pairs of projections 96, but is the effective diameter of the space within which the sphere 95 is "caged" as shown in FIG. 19B. The tumbling action of the spheres 95 within the "cage" formed by a plurality of projections 96 not only enhances mixing but also may be useful in grinding and dispersing solid particles in the fluids. By ensuring that the diameter D is less than the spacing B between the plates 97, the load of the upper plates is carried by the projections 96 and does not bear upon the spheres 95. This allows the spheres to be made from variety of materials and not just those that are capable of bearing such a load. The spheres 95 could be made hollow for light weight and more rapid tumbling.

FIGS. 20–26 illustrate an alternative embodiment of the present invention wherein the plates 80, 81 are mounted within a housing 82 for rotation.

Figure 20:
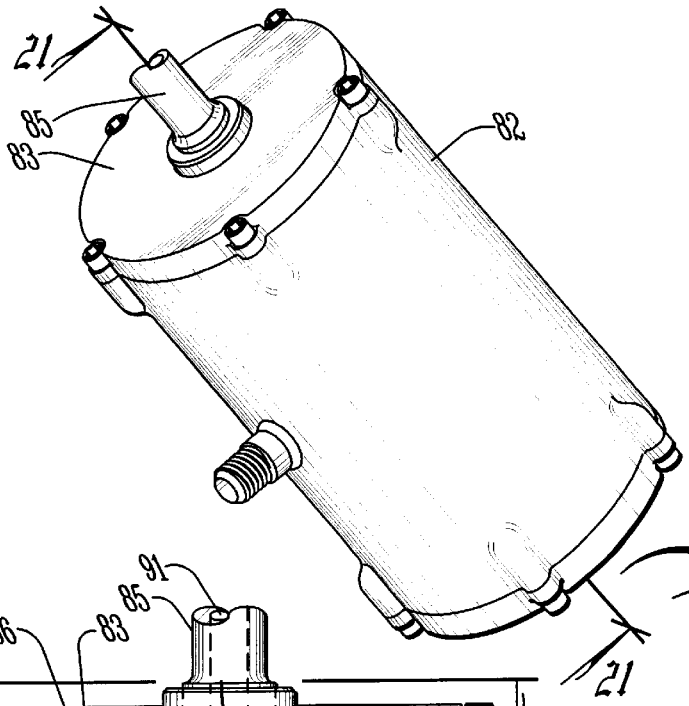
FIGS. 20–26 illustrate an alternative embodiment of the present invention wherein the plates are mounted within the housing for rotation.
Figure 21:
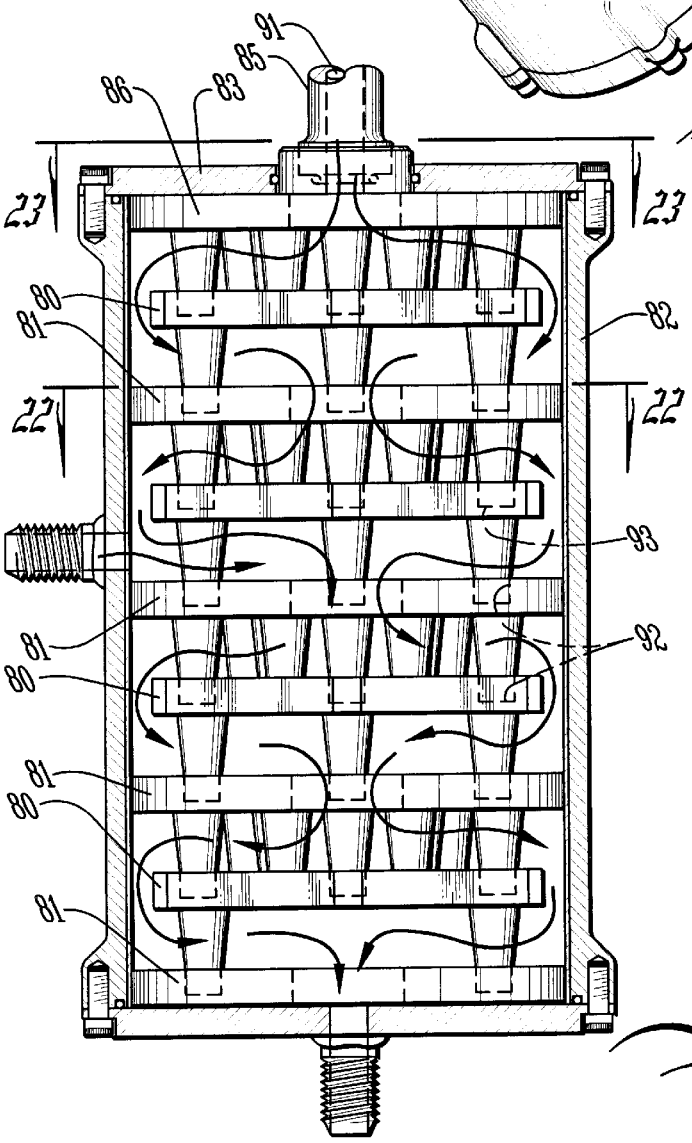
Figure 23:
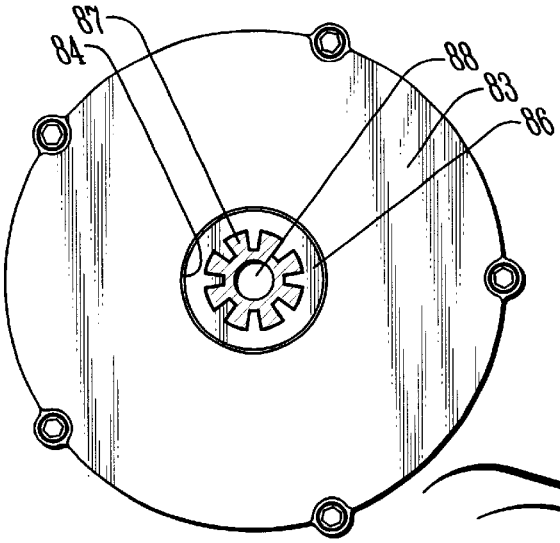
Figure 25:
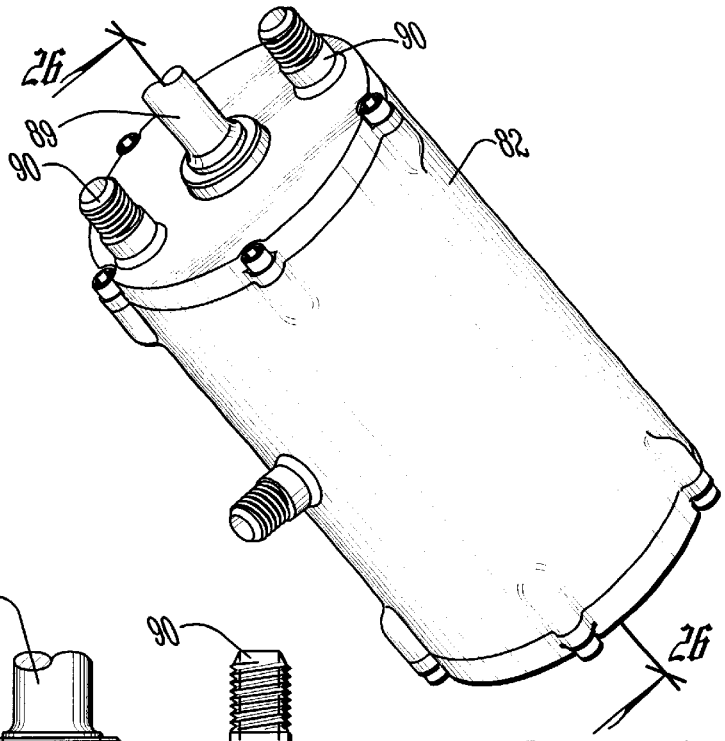
Figure 26:
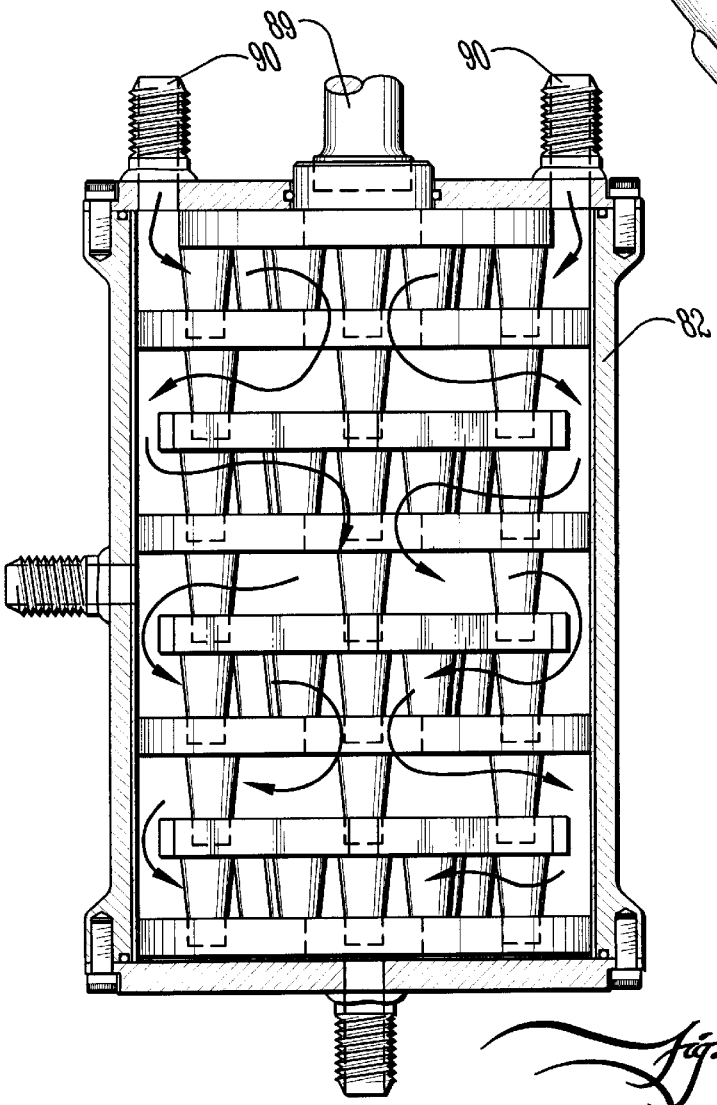

As shown in FIGS. 20 and 23, the end plate 83 which closes off one end of the housing 82, is provided with an opening 84 for receiving a drive shaft 85. In the preferred embodiment, the end of the drive shaft 85 is "toothed" in the manner of a gear. The uppermost plate 86 is modified to have a complementary recess 87 for the "toothed" end of the drive shaft 85 to engage. Other shapes for the end of the drive shaft 85 are contemplated such that the end of the drive shaft 85 is "keyed" into the complementary recess 87 whereby rotation of the drive shaft rotates the interlocked plates as described below. The recess 87 may be blind, i.e., without any communication into the interior of the device, or may have an opening 88 communicating through the uppermost plate 86. In this case fluids may be introduced into the housing 82 through the central bore 91 of a hollow drive shaft 85 as illustrated in FIGS. 20 and 21. Alternatively, the drive shaft 89 may be solid and fluids may be introduced through multiple end ports 90 as shown in FIGS. 25 and 26.

Figure 22:
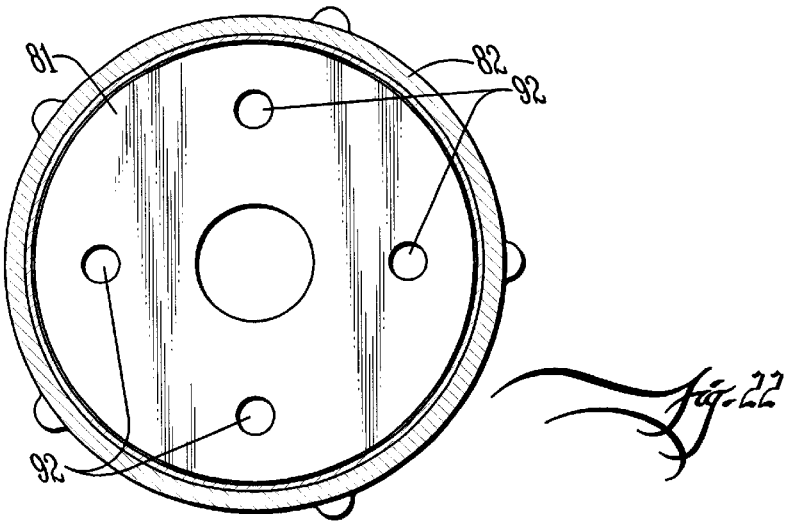
Figure 24:
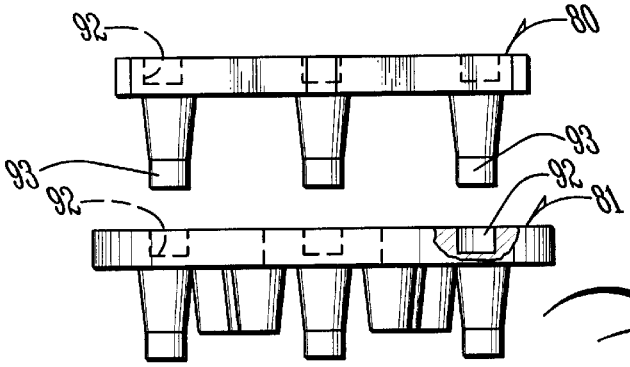

As shown in FIGS. 21, 22 and 24, the plates 80, 81 are interlocked for rotation as a unit. Depressions 92 in the top surface of a plate 80, 81 receive lengthened projections 93 of the next upper plate so that the plates lock together for rotation.

In operation, the uppermost plate 86 interlocks with drive shaft 85 for rotation of the stacked plates 80,81 as a unit within the housing 82. By rotating the stacked plates, the unit may achieved enhanced mixing if the device is used for mixing. Alternatively, the device may be used as a fluid separator by taking advantage of the centrifugal effects induced by rotating the stacked plates.

The device may be manufactured of various materials depending upon the application. For example, parts may be easily molded from various types of plastics. If the device is used in applications where food is processed, it is important that the materials do not contribute any toxic materials to the food and that parts are easily cleaned. If fluids are processed that are introduced into the environment, either as liquids or gases, then the parts must not be constructed of materials that could leach out hazardous pollutants.

The present invention has been described with reference to certain preferred and alternative embodiments that are intended to be exemplary only and not limiting to the full scope of the present invention as set forth in the appended claims.

What is claimed is:

1. A fluid handling device, comprising:

a housing having a first end, a second end, and a side enclosing an interior space, at least one fluid port communicating with said interior space, said housing further having an inner surface bounding said interior and a substantially uniform cross-section for at least a portion of the length of said side;

a plurality of first plates, each of said first plates having a first side, a second side and a periphery having a plurality of extreme points and segments between said extreme points, said extreme points and said segments between said extreme points defining a shape wherein said extreme points of each of said first plates contacts said inner surface of said housing and further wherein said segments between said extreme points define gaps between said periphery and said inner surface of said housing, each of said first plates further having a plurality of projections extending from at least one of said first side and said second side;

a plurality of second plates, each of said second plates having a first side, a second side and a periphery, said periphery defining a shape substantially approximating said cross-section of said housing wherein said periphery of each of said second plates contacts said inner surface of said housing without substantial gaps between said periphery and said inner surface of said housing, each of said second plates further having at least one aperture between said first side and said second side and each of said second plates having a plurality of projections extending from at least one of said first side and said second side;

wherein said first plates and said second plates alternate positions throughout at least a portion of said length of said housing having said uniform cross-section; and wherein each of said first and said second plates further comprises means for interlockinig said plates together and means for rotating said interlocking plates within said housing.

2. The fluid handling device of claim 1, wherein each of said first and said second plates has a sloped upper surface whereby fluids tend to drain to said periphery of said first plate and to said aperture of said second plate.

3. The fluid handling device of claim 1, wherein said means for interlocking said plates comprises a plurality of lengthened projections on at least one of said first plates and said second plates and a plurality of matching depressions on a plate adjacent to said at least one of said first plates and said second plates.

4. The fluid handling device of claim 1, wherein said means for rotating comprises a drive shaft, said drive shaft having an end with means for engaging said interlocking plates, an opening for admitting said drive shaft in one of said first end and said second end, and a complementary recess in an uppermost plate for receiving said end of said drive shaft whereby rotation of said drive shaft rotates said interlocking plates.

5. The fluid handling device of claim 2, wherein each of said first and said second plates is defined by a center axis and said sloped upper surface is defined by straight lines radially from the center axis of said plate.

6. The fluid handling device of claim 2, wherein each of said first and said second plates is defined by a center axis and said sloped upper surface is defined by curved lines radially from the center axis of said plate.

* * * * *

UNITED STATES PATENT AND TRADEMARK OFFICE

CERTIFICATE OF CORRECTION

PATENT NO. : 6,447,158 B1
DATED : September 10, 2002
INVENTOR(S) : Farkas, F.

It is certified that error appears in the above-identified patent and that said Letters Patent is hereby corrected as shown below:

Title page,
Item [*] Notice, replace "0 days" with -- 65 days --.

Signed and Sealed this

Tenth Day of December, 2002

JAMES E. ROGAN
*Director of the United States Patent and Trademark Office*